United States Patent [19]

Dierbeck

[11] Patent Number: 5,042,572

[45] Date of Patent: Aug. 27, 1991

[54] MOUNTING ASSEMBLY FOR MODULAR HEAT EXCHANGER UNITS

[76] Inventor: Robert F. Dierbeck, 2707 Hall Rd., Hartford, Wis. 53027

[21] Appl. No.: 590,342

[22] Filed: Sep. 28, 1990

Related U.S. Application Data

[63] Continuation-in-part of Ser. No. 443,218, Nov. 29, 1989, Pat. No. 4,981,170.

[51] Int. Cl.[5] ..... F28F 9/08; F16L 55/105

[52] U.S. Cl. ..... 165/76; 165/145; 165/173; 138/89; 138/94; 138/94.3; 138/97

[58] Field of Search ..... 165/76, 173, 178, 83, 165/101; 285/325, 326, 19, 31, 901; 138/94.3, 94, 97, 89

[56] References Cited

U.S. PATENT DOCUMENTS

| | | | |
|---|---|---|---|
| 2,243,605 | 5/1941 | Richardson | 285/325 |
| 2,870,863 | 1/1959 | Bramhall | 285/325 |
| 3,280,905 | 10/1966 | Costes | 165/145 |
| 3,376,917 | 4/1968 | Fristoe et al. | 165/145 |
| 4,072,188 | 2/1978 | Wilson et al. | 165/80.4 |
| 4,494,598 | 1/1985 | DeHaan et al. | 165/47 |

FOREIGN PATENT DOCUMENTS

| | | | |
|---|---|---|---|
| 430345 | 1/1925 | Fed. Rep. of Germany | 165/76 |
| 3517488 | 11/1986 | Fed. Rep. of Germany | 165/173 |
| 280885 | 12/1930 | Italy | 165/76 |
| 221919 | 9/1987 | Japan | 165/76 |

*Primary Examiner*—John Rivell
*Assistant Examiner*—L. R. Leo
*Attorney, Agent, or Firm*—Andrus, Sceales, Starke & Sawall

[57] ABSTRACT

A demountable connector assembly for a modular heat exchanger permits individual modules to be removed and replaced without replacement of the entire heat exchanger core. As applied to heat exchanger modules of conventional tube and header construction, an end chamber on each end of the module has a thin flexible wall which allows axial extension of the module when it is installed between parallel inlet and outlet header surfaces to obviate the imposition of damaging stresses on the soldered connection joints between the heat exchanger tubes and the header plates. The mounting assembly also allows the headers to be temporarily sealed while a module is removed to allow continued operation of the heat exchanger until a replacement module can be installed.

5 Claims, 4 Drawing Sheets

MOUNTING ASSEMBLY FOR MODULAR HEAT EXCHANGER UNITS

This application is a continuation-in-part of Serial No. 07/443,218 filed Nov. 29, 1989, now U.S. Pat. No. 4,981,170.

BACKGROUND OF THE INVENTION

The present invention pertains to heat exchangers for flowing fluid materials and, more particularly, to a modular heat exchanger construction in which the individual modules utilize easily demountable connectors to facilitate separate module replacement.

The prior art discloses the use of heat exchangers in which the tubular outer wall of the conduit containing the fluid flow is corrugated. Typically, each of the corrugations is provided with an interior baffle plate which blocks direct flow of the fluid through the conduit and causes the fluid to be diverted from a purely axial flow. The diversion of fluid flow by the baffle plate slows the flow through the conduit somewhat and enhances the heat exchanging contact between the fluid and the walls of the conduit, the surface area of which is substantially enhanced by the corrugated construction.

More conventional heat exchanger construction, particularly heat exchangers adapted for automotive use, utilize the so-called "tube and header" construction. In this type of heat exchanger, a core element including a series of generally parallel tubular conduits extends between and are attached at their opposite ends to inlet and outlet headers. The tubular conduits are also generally provided with attached heat conducting and dissipating fins which may be of either a flat plate or serpentine construction. The rigid joints between the fluid conduits and the headers are generally soldered or brazed and, as is well known in the art, are relatively weak. In fact, the soldered joints constitute the weakest points in a typical tube and header heat exchanger construction and are generally the first to fail under excessive loadings which may, for example, be caused by thermal expansion or shock loads. Thus, no significant axial elongation of a conventional heat exchanger module resulting in relative movement between the fluid conduits and the header or header plates can be tolerated.

Conventional automotive heat exchangers or radiators typically have an upper inlet header and a lower outlet header between which the core unit is mounted and all of which is enclosed in a generally rectangular supporting frame. This rigid mounting of a conventional tube and header core exposes it to joint failure as a result of thermal forces as well as shock loads. Heat exchangers utilizing a corrugated conduit construction might be manufactured to allow some axial strain under load which will avoid failure of the connecting joints. In either type of construction, it has always been desirable to provide a modular construction in which the entire heat exchanger unit may comprise a series of individual modules which can be separately replaced if damaged or destroyed. Such a modular construction would be particularly attractive in conventional tube and header heat exchanger constructions where serious damage to the core element usually requires replacement of the entire core.

U.S. Pat. No. 1,816,159 shows a corrugated conduit heat exchanger which may be mounted between a pair of oppositely disposed headers via axially bolted end plates. German Patent 577,743 and British Patent 114,821 disclose modular tube and header heat exchanger constructions in which the individual tubular modules are connected between the headers with threaded connectors. However, the threaded attachment of the connectors imposes an axial strain on the modules which might result in fracture of the soldered joints. French Patent No. 673,524 discloses modular heat exchanger elements, but the same are demountably detached to the outer faces of the headers, rather than between the headers as in conventional construction.

SUMMARY OF THE INVENTION

In accordance with the present invention, a unique mounting assembly may be used to demountably attach either tube and header or corrugated heat exchanger modules in a true modular configuration. When applied particularly to heat exchanger modules utilizing tube and header construction, the mounting assembly of the present invention provides the convenience of modular construction while simultaneously eliminating the detriments inherent in prior art unitary tube and header core constructions.

Each heat exchanger module in one embodiment of the present invention is mounted between an inlet header and an outlet header, and includes a series of generally parallel tubular conduits which extend between and are attached at their opposite ends, as by soldered joints, to a pair of header plates. Each of the headers has a surface which defines a fluid opening to or from the heat exchanger module and the header surfaces are disposed in spaced, parallel face-to-face relation. An end plate is attached by its outer edge to the outer edge of each header plate to form therewith an end chamber on each end of the heat exchanger module. Each end plate has a centrally attached flange which defines a chamber opening. A compressible seal is positioned between each flange and the adjacent header surface surrounding the fluid opening therein. A mounting bracket is attached to each of the headers in alignment with the fluid opening, with each header bracket defining with the header surface a mounting slot for receipt of the flange and compressible seal on end of the module. A pressure plate is slidably insertable into each slot between the mounting bracket and the flange and, by a wedging action, compresses the seal and secures the module to the header. One of the end plates is constructed to be flexible in the direction of the longitudinal axis of the module to accommodate axial elongation of the module between the flanges in response to compression of the seals during mounting.

In a preferred embodiment, both end plates are flexible and are of thin sheet metal construction. In the preferred embodiment, the headers are provided with a series of fluid openings in their opposed spaced parallel surfaces, which openings define opposed pairs of fluid openings between which a heat exchanger module may be demountably attached.

Within the confines of a conventional heat exchanger supporting frame, two or more tiers of parallel arrays of heat exchanger modules may be mounted utilizing an intermediate header or headers, each of which includes a series of fluid openings on parallel opposite header wall surfaces. Utilizing the demountable attachment assembly of the present invention, each intermediate header simultaneously accommodates connections from the outlet ends of the modules in one tier and the inlet ends of the modules in the other tier. Any module in the assembly may be readily removed for repair or replacement and, in a further unique aspect of the invention, the fluid openings in the header to and from a damaged module may be temporarily plugged utilizing a solid shim inserted between the compressible seal and the surface of the header.

DETAILED DESCRIPTION OF THE PREFERRED EMBODIMENT

Figure 1:
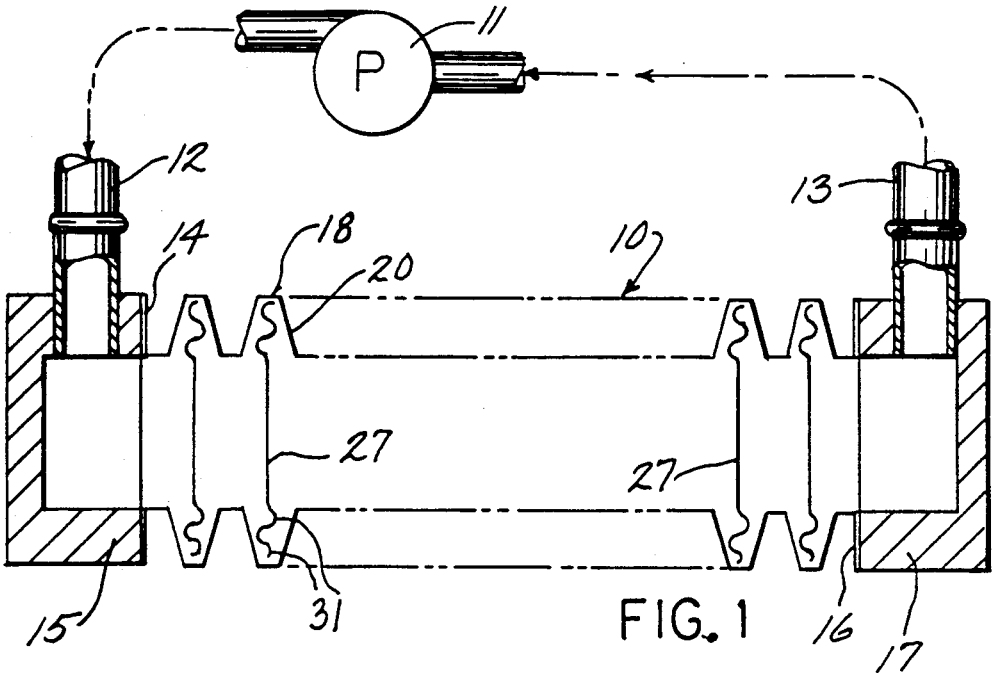
FIG. 1 is a partial axial cross section through the heat exchanger of one embodiment of the present invention and additionally showing its connection to a pump for circulating the flow of a fluid therethrough.

Referring to FIG. 1, a heat exchanger 10 of the present invention is shown operatively attached to a pump 11 which causes a fluid to flow into the inlet 12 of the heat exchanger and to exit therefrom through an outlet 13 for return to the pump. The pump, for example, may comprise the water pump on an internal combustion engine. However, the heat exchanger to be described in more detail hereinafter is also suited for cooling other fluids such as engine oil or engine combustion air, as well as for cooling or heating a variety of other fluids for entirely different applications.

Figure 2:
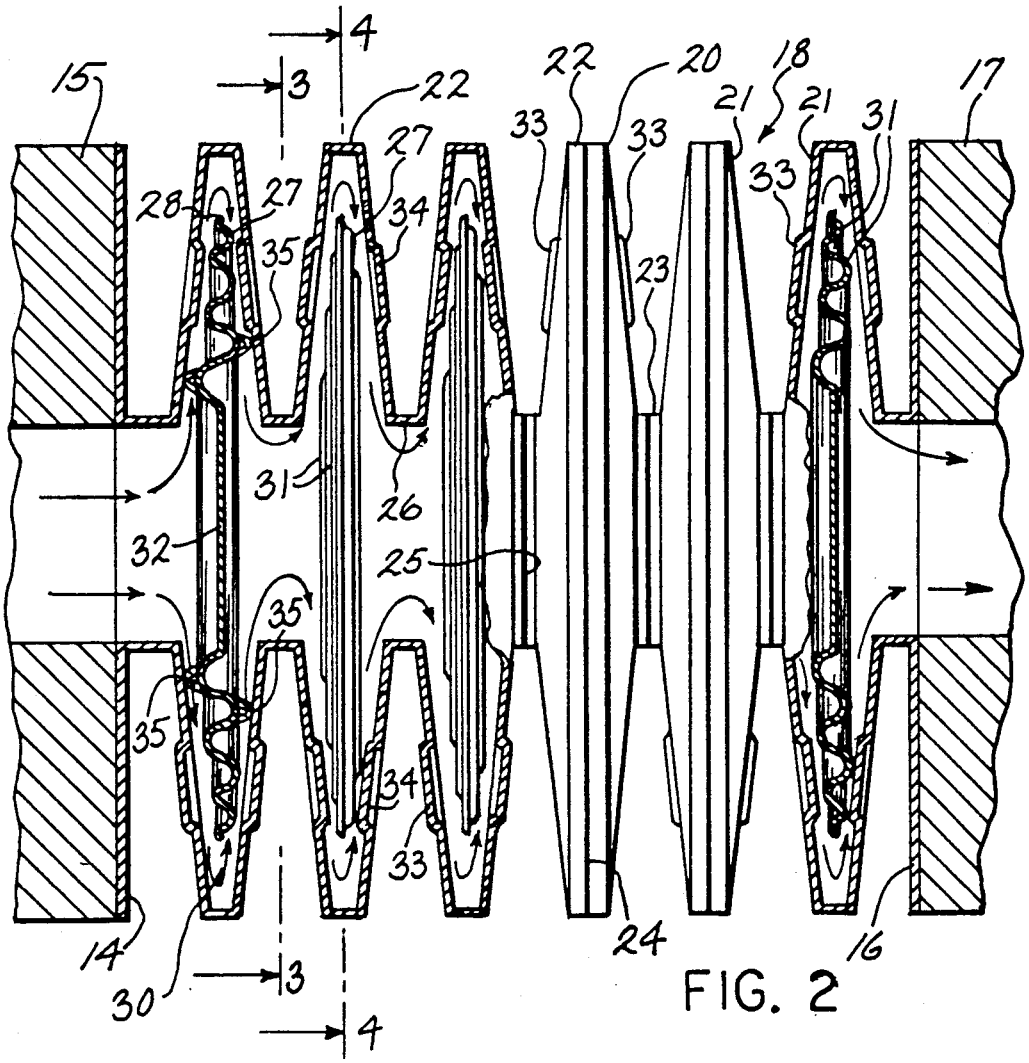
FIG. 2 is an enlarged partial axial section through the heat exchanger shown in FIG. 1.
Figure 3:
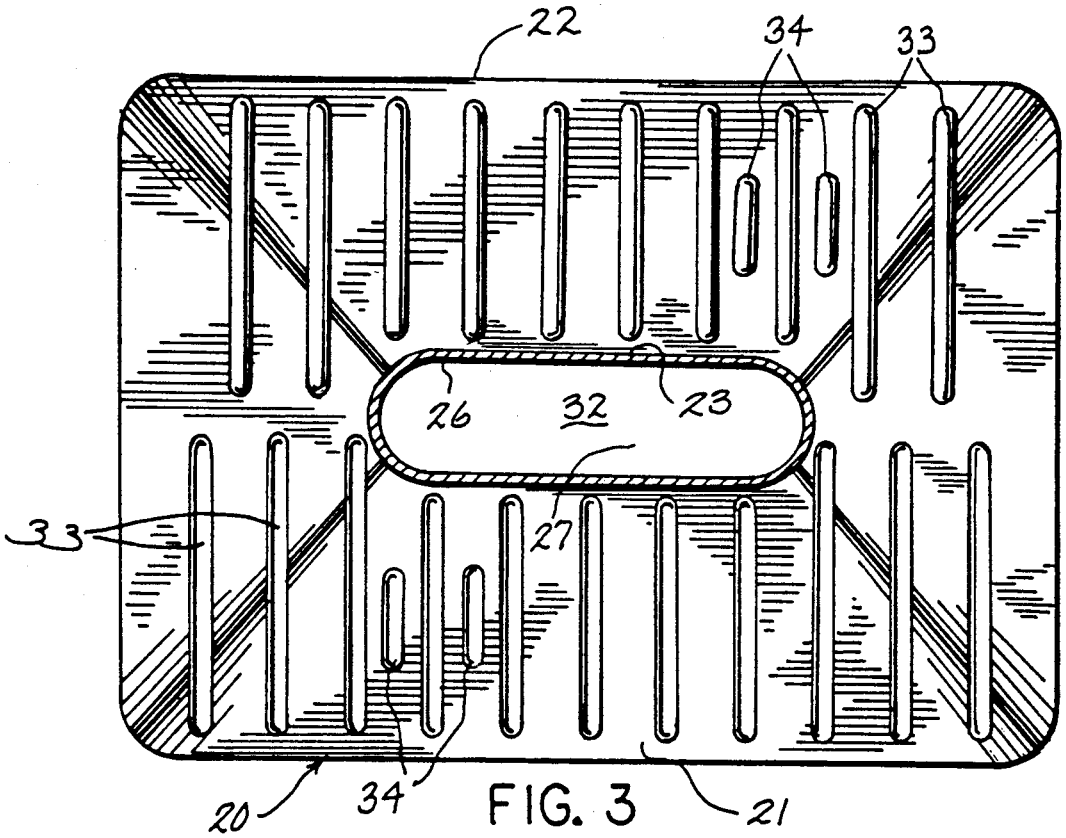
FIG. 3 is a section through the heat exchanger taken on line 3—3 of FIG. 2.
Figure 4:
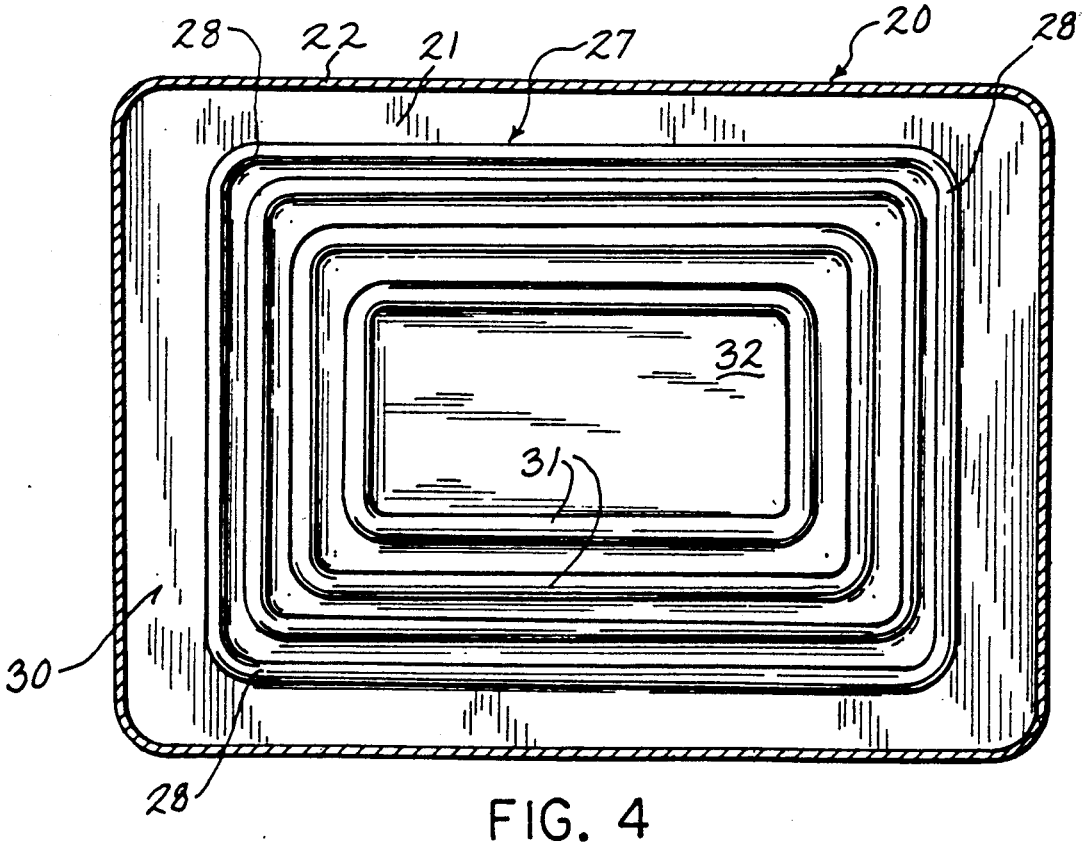
FIG. 4 is a section through the heat exchanger taken on line 4—4 of FIG. 2.

The heat exchanger includes a tubular conduit 18 which has an inlet flange 14 on one end for attachment to an inlet header 15 and an outlet flange 16 on the opposite end for attachment to an outlet header 17. The tubular conduit 18 comprises a series of generally parallel and axially spaced corrugations 20, each of which is identical. Referring also to FIGS. 2, 3 and 4, each corrugation 20 is formed from a pair of identical dish-shaped wall sections 21, each wall section including an outer flange 22 and an inner flange 23. The outer and inner flanges of each wall section extend in opposite axial directions and, to form a corrugation 20, a pair of opposed wall sections 21 are joined at the edges of their outer flanges 22 with a continuous outer seam 24. Similarly, adjacent corrugations 20 comprising the tubular conduit 18 are connected by joining the edges of adjacent inner flanges 23 with a continuous inner seam 25. The seams 24 and 25 may be provided by welding, brazing, soldering, or even gluing in any manner which will provide a leak-tight seal of requisite strength.

The inner flanges 23 join adjacent corrugations 20 and also provide central openings 26 for the flow of fluid from one corrugation to the next and thus, through the heat exchanger. In the presently preferred construction and referring particularly to FIG. 3, the corrugations 20 are of a generally rectangular shape, as viewed in a plane normal to the axis of the heat exchanger. The surfaces of the wall sections 21 of each corrugation diverge radially inwardly such that each corrugation is narrowest at its peripheral outer edge, defined by the outer flanges 22, and widest at its inner edge, defined by the inner flanges 23.

Within each hollow corrugation 20 there is mounted a baffle or turbulator plate 27. Each turbulator plate comprises a solid sheet having a shape generally the same as the corrugation, namely, rectangular in the preferred embodiment shown in FIG. 3. Because of the solid construction of the turbulator plate 27, it poses a barrier to the direct flow of fluid through a corrugation from one central opening 26 to the other. However, the turbulator plate is somewhat smaller than the corrugation such that its outer peripheral edge 28 is spaced radially inwardly from the attached outer flanges 22 of the corrugation to define a peripheral fluid flow passage 30 therebetween. Thus, the fluid flowing into a corrugation from an adjacent upstream corrugation (or from the inlet header 15) will be diverted radially outwardly by the solid turbulator plate 27, flow around the outer peripheral edge 28 and through the fluid flow passage 30 and radially inwardly to the downstream central opening 26. This provides the general function of a typical baffle plate to slow somewhat the flow of fluid and to assure its enhanced contact with a larger heat exchanging surface area.

To further enhance the heat exchanging capability, each of the turbulator plates 27 is provided with a series of turbulator ribs 31 which extend generally normal to the direction of radial fluid flow over the plate, as just described. The ribs 31 thus provide at least a partial barrier to the fluid flow and surface irregularities which cause turbulence and mixing of the fluid to further enhance heat exchanging contact with the walls of the corrugations. The turbulator ribs are formed in and extend from both sides of the turbulator plate 27 to present similar ribbed surfaces on both sides. Preferably, the ribs extend continuously along and around the entire surface of the plate and, in the preferred rectangular configuration, comprise a concentric array of rectangular ribs that extend radially from the outer peripheral edge 28 to the portion of the plate adjacent the central opening 26 in the corrugation. The center 32 of the turbulator plate is smooth and, as previously indicated, solid to present a direct barrier to fluid flow. The size of the ribs 31 varies radially to conform to the divergent orientation of the wall sections 21 between which each turbulator plate is mounted. Thus, referring particularly to FIG. 2, the array of ribs in each plate is generally wave-shaped in cross section and defines a wave of increasing amplitude in a radial inward direction.

The outer surfaces of the wall sections 21 of each corrugation 20 are provided with a plurality of outwardly extending convex protrusions 33. The protrusions are relatively narrow and long and, in the preferred rectangular shape shown in FIG. 3, are positioned generally parallel to one another and perpendicular to the longer edges of the rectangular corrugation. Thus, for example, if the heat exchanger 10 of the present invention is utilized to remove heat from the engine coolant in an internal combustion engine, the cooling air flowing across the exterior of the heat exchanger will be caused to flow in the long direction of the rectangular shape and perpendicular to the convex protrusions 33. This assures an optimum flow of air over the greatest heat exchanging surface and the convex protrusions 33 are disposed to maximize air turbulent.

The walls 21 of each corrugation 20 may also be provided with a plurality of concave protrusions 34 which extend into the interior of the corrugation. The concave protrusions may be adapted to serve two separate and distinct purposes. First of all, the concave protrusions 34 enhance the heat exchanging surface area and provide interruptions which help create turbulence in the flow of fluid within the heat exchanger. In addition, concave protrusions extending inwardly from opposite wall sections 21 may be utilized to capture and hold in place the turbulator plate 27. As shown in FIG. 2, the concave protrusions 34 may be positioned to bear upon the crests of the ribs 31 as a pair of wall sections 21 are brought together and sealed along the continuous outer seam 24. Some separation must be maintained between the crests of the ribs and the inner surfaces of the wall sections 21, otherwise the flow of fluid therebetween would be restricted. The concave protrusions 34 thus also provide the requisite spacing. These inwardly extending protrusions may be dispersed between the outwardly extending convex protrusions 23 and of a substantially shorter length, as shown. Alternately, the concave protrusions 34 may be formed of generally the same length and alternately with the convex protrusions. If necessary, the contacting surfaces of the concave protrusions 34 and the crests of the ribs 31 may be utilized to spot weld, braze or otherwise secure the parts together. However, because of the inwardly divergent shape of the wall sections 21 and the corresponding increase in the depth or amplitude of the wave-like ribs 31, the turbulator plates 27 are inherently captured and held in position between the wall sections as the latter are welded or otherwise secured together.

In lieu of utilizing concave protrusions 34 as a means of positioning and maintaining the spacing between the turbulator plate and the adjacent surfaces of the wall sections, the crests of certain of the turbulator ribs 31 may be provided with spaced upset portions 35 (see FIG. 2) which extend into contact with the inside surfaces of the wall sections 21. The small upset portions 35 may be formed in any convenient manner and, preferably, in the same stamping operation in which the ribs themselves are formed in the plates 27. If necessary or desirable, the upset portions 35 may also be utilized as brazing surfaces to positively attach the plates to the corrugation walls.

The heat exchanger 10 of the present invention may be made entirely of a stamped sheet metal construction. Both the corrugations 20 and the baffle or turbulator plates 27 may be made of thin sheets of steel or brass, for example, with a typical material thickness of 0.018–0.020 inches (0.46–0.51 mm). With the appropriate tooling, the dish-shaped wall sections 21 including the outer and inner flanges 22 and 23 and convex and/or concave protrusions 33 and 34 may be stamped in a single step. The outer and inner seams 24 and 25 are preferably made by welding, but brazing and other methods may also be utilized. As compared to conventional automotive heat exchanger constructions, the present invention is advantageously distinguished by its elimination of soldered seams and connections which are known to be troublesome.

Figure 5:
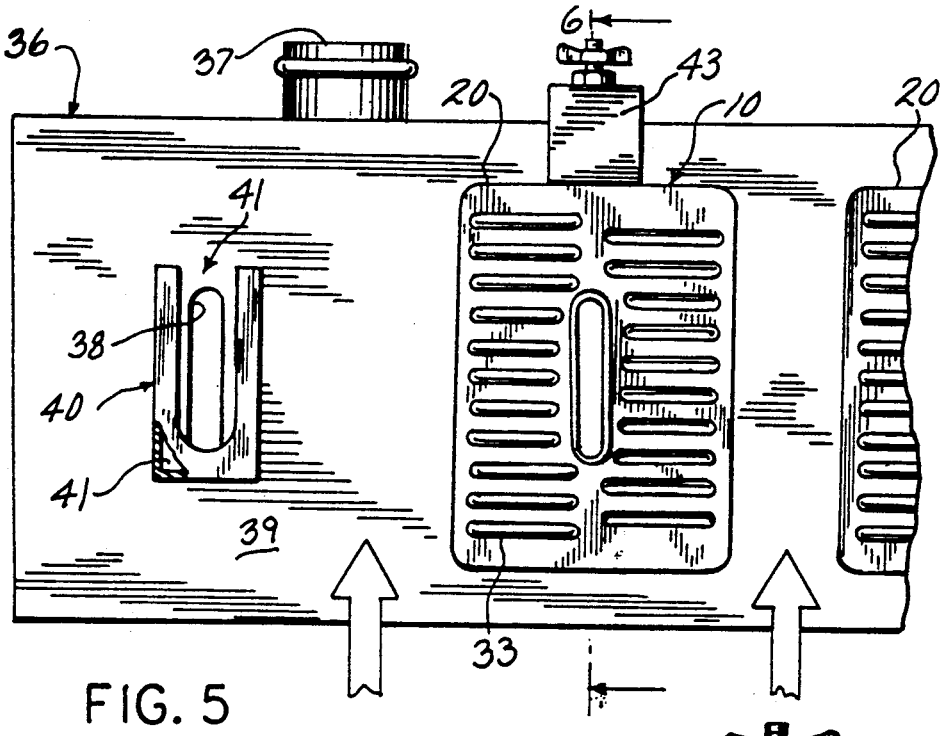
FIG. 5 is a bottom plan view of a common inlet tank showing details of the connection assembly of the present invention.
Figure 6:
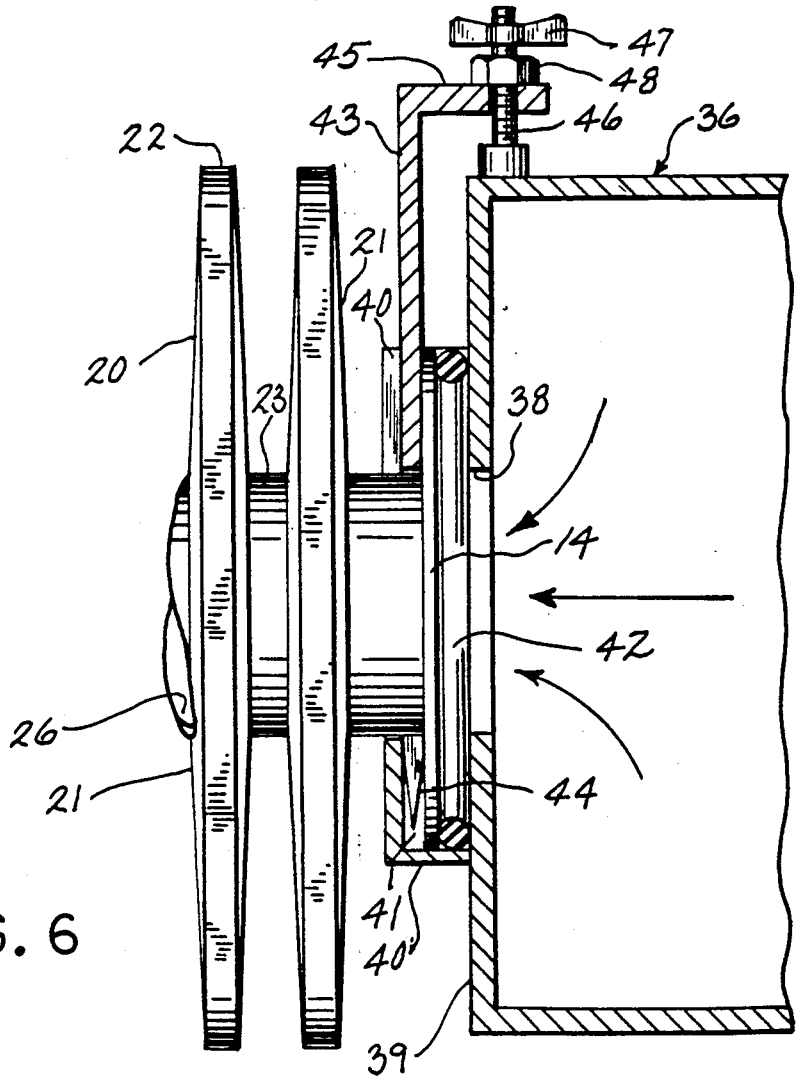
FIG. 6 is a sectional view of the heat exchanger taken on line 6—6 of FIG. 5.
Figure 8:
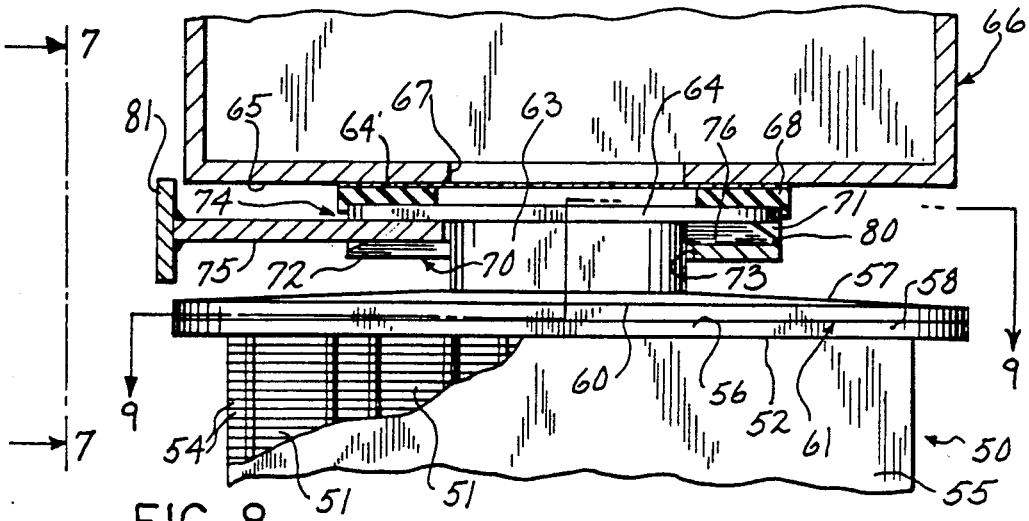
FIG. 8 is a sectional view of the heat exchanger shown in FIG. 7 generally similar to FIG. 6.
Figure 9:
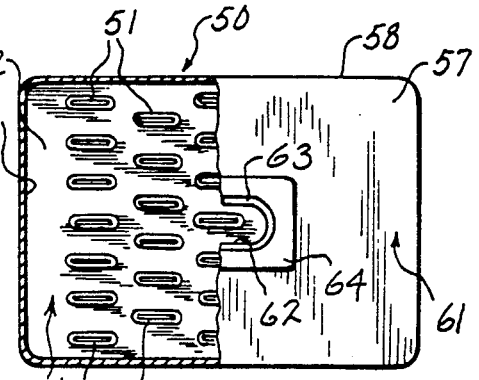
FIG. 9 is a partial sectional view taken on line 9—9 of FIG. 8.

Referring to FIGS. 5 and 6, there is shown an assembly for mounting a number of heat exchangers 10 of the present invention in a system for handling a flow of engine coolant. A similar system may, however, also be utilized for cooling (or heating) other liquids and/or gases. In place of an inlet header 15, as shown in FIG. 2, an inlet tank 36 is positioned above a parallel arrangement of heat exchangers 10. The inlet tank 36 includes a conventional inlet opening 37 for the attachment of a coolant supply hose or the like, such as from the water pump 11 (FIG. 1). The bottom surface 39 of the tank 36 includes a series of spaced outlet openings 38 which are elongated and of the same general shape as the central opening 26 through the heat exchanger conduit 18. A mounting bracket 40 is attached to the lower surface of the tank 36 surrounding each of the outlet openings 38. The mounting bracket 40 is of a U-shaped construction and of a shape corresponding to but slightly larger than the inner flange 23 of the first corrugation 20 attached to the inlet flange 14 of the heat exchanger conduit. The mounting bracket is mounted spaced from the surface of the tank and the open end of the U defines a slot 41 between the bracket and the bottom surface 39 of the tank into which the inlet flange and an appropriate sealing ring 42 may be slid into place such that the central opening 26 in the inlet flange 14 is in alignment with the outlet opening 38 in the bottom tank surface 39.

To secure the heat exchanger conduit in place and to press the inlet flange 14 and sealing ring 42 into sealing engagement with the surface of the tank surrounding the outlet opening 38, a wedge-shaped pressure plate 43 is inserted into the open end of the slot 41 between the inside surface of the mounting bracket 40 and the opposing face of the inlet flange 14. The pressure plate 43 has a bifurcated construction defined by a pair of spaced legs 44 which overlie the legs of the U-shaped slot 41 and, in a similar manner, surround the inner flange 23 defining the central opening 26 immediately adjacent the inlet flange 14. The wedging action of the pressure plate compresses the sealing ring 42 and secures the assembly together. The opposite end of the pressure plate 43 includes a mounting flange 45 having a threaded hole therein for receipt of a tightening screw 46 adapted to bear against the side wall of the inlet tank 36. The screw 46 may be rotated by hand with the integral wing nut 47 to establish the final position of the pressure plate 43 and the position maintained by tightening a lock nut 48 against the mounting flange 45.

The assembly for mounting the heat exchanger conduits to the supply tank is simple and effective, yet allows individual heat exchanger units to be replaced if necessary without the need to break and remake a soldered connection, as is necessary in conventional automotive radiator constructions. The outlet flange 16 of each heat exchanger unit may be similarly attached to a common outlet header (not shown) for the several tubular conduits in a manner identical to the inlet end. As indicated previously, each of the tubular conduits 18 of a preferred rectangular shape is oriented in the direction of flow of the cooling air past the unit, as indicated by the large arrows in FIG. 5. This orientation provides optimized air turbulence and heat transfer.

Referring to FIGS. 7–10, the mounting assembly of the present invention may be adapted for use with heat exchanger modules 50 utilizing conventional tube and header construction. Each module 50 includes a series of tubular conduits 51 which extend in a generally parallel orientation between a pair of header plates 52. Each header plate is provided with a pattern of holes 53, each of which holes is adapted to receive one end of a tubular conduit 51 which is rigidly secured therein with a soldered or brazed connection, all in a well known manner. A multiplicity of fairly densely packed heat exchanging fins 54 are attached to the tubular conduits between the header plates 52, also in a known manner. The tube and fin assembly may be supported on opposite faces by a pair of side plates 55, but the module 50 is open in a direction parallel to the side plates to allow cooling air to flow readily over the tubes and fins.

Each header plate 52 has its peripheral edge upturned in a direction away from the module to form a peripheral lip 56. The header plates are relatively stiff and such stiffness is substantially enhanced by the rigid soldered connections of the multiple tubular conduits 51. A thin flexible end plate 57 is attached by its outer peripheral edge to the peripheral lip 56 of the header plate 52. Each end plate 57 may be of a construction substantially identical to the dish-shaped wall section 21 utilized in the embodiment previously described. Thus, the end plate may include a peripheral outer flange 58 for direct attachment to the lip 56 of the header plate, as with a soldered, brazed or welded seam 60. The connected header plate 52 and end plate 57 form chambers 61 on each end of the module 50.

The end plate 57 is provided with a central opening 62 (like the opening 26 of the previously described embodiment), which opening 62 is defined by an axially extending sleeve 63. The opposite end of the sleeve 63 has attached thereto a mounting flange 64, also of a construction similar to that previously described. The mounting flange 64 is adapted to overlie the bottom surface 65 of the inlet header 66 such that the central opening 62 to the chamber 61 is aligned with the outlet opening 67 from the header. A continuous compressible sealing member 68 overlies the outer face of the mounting flange 64.

The inlet header 66 is provided with a series of outlet openings 67 and a mounting bracket 70 is attached to the bottom surface 65 of the header at each fluid opening. Each of the mounting brackets 70 has a generally channel shape when viewed in FIG. 7 and includes a pair of parallel side flanges 71 secured to the header surface and an integral center plate 72 extending between the side flanges 71. The center plate 72 is provided with a U-shaped notch 73 large enough to allow the sleeve 63 on the end plate 57 to extend therein. The interior of the mounting bracket 70 and the bottom surface 65 of the header define a mounting slot 74 into which the mounting flange 64 and sealing member 68 may be slid as the sleeve 63 is received in the U-shaped notch 73. It is to be understood that the opposite end of each module 50 (which is attached either to an intermediate header 77 or an outlet header 78 as will be described in greater detail) is provided with an identical mounting assembly such that the mounting flange/sealing member subassemblies on each end of the module are simultaneously inserted into the mounting slots 74 in the mounting brackets.

A pressure plate 75 is then slidably inserted into the mounting slot between the inside surface of the center plate 72 and the surface of the mounting flange 64 opposite the sealing member to compress the sealing member against the header surface and secure the module thereto. The pressure plate is bifurcated to define a pair of legs 76 which straddle the sleeve 63 as the pressure plate is inserted into the mounting slot. The remote edges of the legs 76 are provided with relatively sharp edges 80 to facilitate initial insertion of the legs between the mounting bracket 70 and the mounting flange 64. The pressure plate may also be provided with a flanged handle 81 to facilitate manual insertion and removal of the pressure plate.

In a typical installation, the mounting flanges 64 and sealing members 68 on opposite ends of the module are slid into their respective mounting brackets 70. One of the pressure plates 75 is then inserted, as indicated, to secure that end of the module to the header, while simultaneously compressing the sealing member 68 to provide a fluid-tight seal. As the pressure plate 75 on the other end of the module is inserted between the mounting bracket and the mounting flange, the sealing member 68 will begin to be compressed, but the wedging action of the pressure plate will also cause an axial elongation of the module. Such axial elongation will be readily accommodated by the flexible end plates 57 so that no undue tensile load is imposed upon the relatively low strength joints between the tubular conduits 51 and the header plates 52.

The inherent flexibility of the end plates 57 forming one wall of the chambers 61 on each end of the module will also accommodate substantial axial movement of the module as a result of thermal stresses, blows to the heat exchanger frame, or a twisting thereof resulting from movement of the vehicle frame to which the heat exchanger may be attached.

Figure 10:
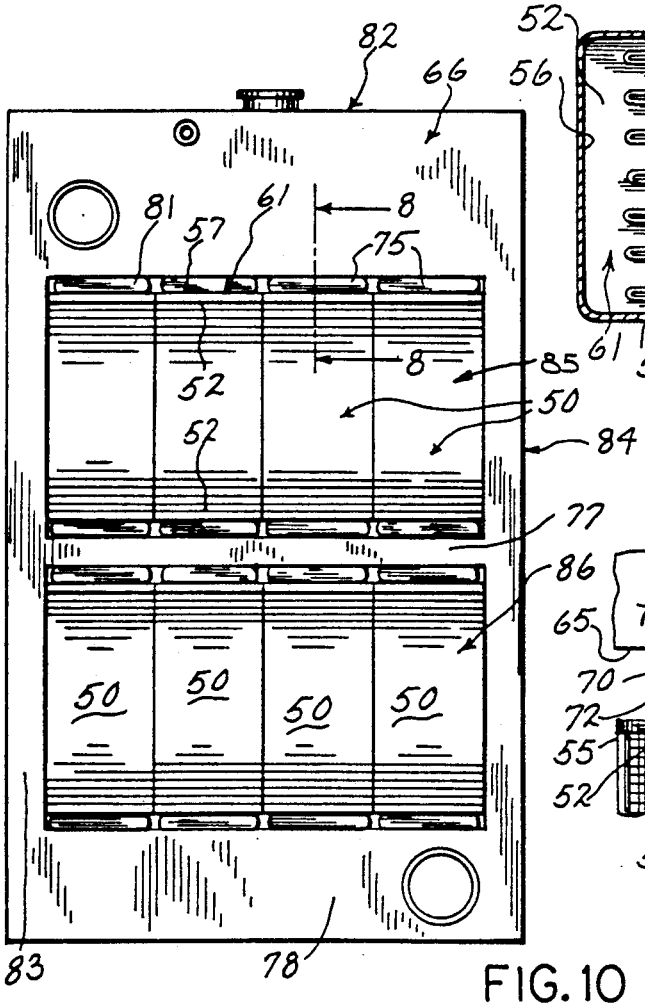
FIG. 10 is a front elevation of a modular heat exchanger utilizing the modules and mounting assembly of the present invention.
Figure 7:
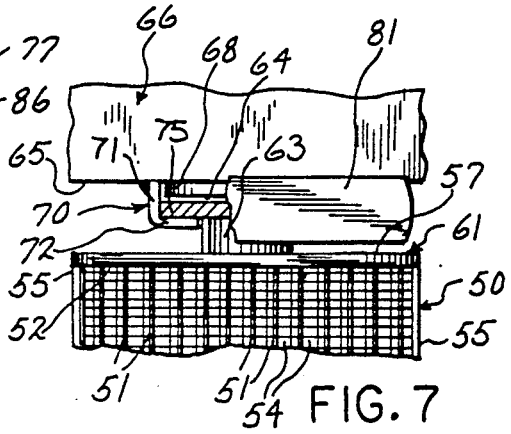
FIG. 7 is a front elevation of a portion of a modular heat exchanger utilizing tube and header construction and the mounting assembly of the present invention.

Referring to FIG. 10, a modular heat exchanger 82 includes the upper inlet header 66, intermediate header 77 and lower outlet header 78 all tied together by a pair of side frame members 83 to form a generally rectangular supporting frame 84. In the heat exchanger construction shown, upper and lower parallel arrays 85 and 86 of modules 50 are disposed in two tiers separated by the intermediate header 77. Each module 50 in the upper array 85 and the lower array 86 includes a flexible walled chamber 61 and mounting bracket assembly on each end. Each of the headers 66, 77 and 78 has a substantially open interior for the fluid flowing into or out of the modules 50. If an individual module 50 is damaged so that fluid is escaping from the system, that module is simply replaced by reversing the mounting procedure described above and a replacement module attached in its place. However, should a replacement module not be available, the openings in the two headers to and from the damaged module may be temporarily plugged and operation of the heat exchanger continued without a significant loss of heat exchanging capacity. To temporarily plug a header opening, the pressure plate 75 is removed, a thin solid shim 64 (see FIG. 8) in the approximate shape of a mounting flange 64 is inserted in the mounting slot 74 between the seal 68 and the header surface, and the pressure plate 75 is reinserted to compress the sealing member, force the shim against the surface of the header, and close off the header opening. The open interiors of the various headers allow fluid flow through all remaining modules to be maintained. By leaving the damaged module in place, uniform flow of cooling air through the entire heat exchanger may be maintained. The shim may be constructed of any material which is strong and rigid enough to provide a barrier to fluid flow and yet provide an adequate temporary seal. Various types of plastic materials are believed to be suitable and the shim may have a thickness in the range of, for example, 0.005–0.010 inch.

Various modes of carrying out the present invention are contemplated as being within the scope of the following claims particularly pointing out and distinctly claiming the subject matter which is regarded as the invention.

I claim:

1. An assembly for demountably attaching a heat exchanger module between an inlet header and an outlet header, said module including fluid conducting and heat exchanging conduit means extending between and attached at their opposite ends to a pair of header plates, said assembly comprising:

each of said headers having a surface defining a fluid opening, said surfaces disposed in spaced, parallel face-to-face relation;

an end plate attached by its outer edge to the outer edge of each header plate to form therewith a module end chamber;

each end plate having a centrally attached flange defining a chamber opening;

a compressible seal positioned between each flange and the header surface surrounding the fluid opening;

a mounting bracket attached to each of the headers in alignment with the fluid opening, each bracket defining with the surface of the header a mounting slot for receipt of the flange and compressible seal on one end of the module;

a pressure plate slidably insertable into each slot between the mounting bracket and the flange to compress the seal and secure the module to the header; and, one of said end plates being flexible in the direction of the longitudinal axis of the module to accommodate axial elongation of the module between the flanges in response to compression of the seals during mounting.

2. The apparatus as set forth in claim 1 wherein both of said end plates are flexible.

3. A modular heat exchanger comprising:

a generally rectangular supporting frame;

an inlet header and an outlet header on opposite sides of the frame;

said headers having opposed spaced parallel surfaces, each surface having a series of fluid openings defining opposed pairs of fluid openings in said surfaces;

a heat exchanger module interconnecting each opposed pair of fluid openings to provide a parallel array of modules within the frame;

each module including fluid conducting and heat exchanging conduit means extending axially between and attached at opposite ends with rigid connections to a pair of header plates, a flexible end plate secured along its outer edge to the outer edge of each header plate to form therewith an axially expansible chamber, each end plate having a centrally attached flange defining a chamber opening corresponding to one of said pair of fluid openings, and a compressible seal positioned between each flange and the header surface surrounding one of said fluid openings;

mounting bracket means attached to each of the headers in alignment with the series of fluid openings in the header surface, said bracket means defining with the header surface a series of mounting slots for receipt of the flange and seal on the common ends of the modules;

a pressure plate slidably insertable into each slot between the bracket means and the flange to compress the seal and attach the module end to the header; and said end plates flexing in response to compression of the seal to accommodate axial expansion of said axially expansible chambers and axial elongation of the modules without overstressing said rigid connections.

4. The apparatus as set forth in claim 3 wherein the outlet header comprises an intermediate header having an opposite second surface parallel to said outlet header surface, said second surface having a third series of fluid openings, and further including a second outlet header having an outlet surface parallel to said second surface, said outlet surface having a fourth series of fluid openings defining with the third series of fluid openings second opposed pairs of fluid openings; and, a second parallel array of heat exchanger modules each demountably interconnecting one of said second pairs of fluid openings.

5. The apparatus as set forth in claim 3 including means for temporarily closing one of said opposed pairs of fluid openings preparatory to replacement of the heat exchanger module comprising:

solid shim means having an outside shape corresponding generally to the flange on the end plate;

said shim means being sufficiently thick for insertion into said mounting slot between the seal and the header surface and over said fluid opening after removal of said pressure plate and to allow reinsertion of said pressure plate to secure said shim means therein.

* * * * *